US007722049B2

(12) United States Patent
Williams et al.

(10) Patent No.: US 7,722,049 B2
(45) Date of Patent: May 25, 2010

(54) MULTIPURPOSE BOWL

(75) Inventors: Michael Williams, Old Hickory, TN (US); Rachel DeSmidt, Monona, WI (US); William Lindeman, Marshall, WI (US); Cathy Lindeman, legal representative, Marshall, WI (US)

(73) Assignee: Wabash Valley Farms, Monon, IN (US)

( * ) Notice: Subject to any disclaimer, the term of this patent is extended or adjusted under 35 U.S.C. 154(b) by 303 days.

(21) Appl. No.: 12/022,347

(22) Filed: Jan. 30, 2008

(65) Prior Publication Data

US 2008/0211189 A1 Sep. 4, 2008

Related U.S. Application Data

(60) Provisional application No. 60/887,480, filed on Jan. 31, 2007.

(51) Int. Cl.
*A63F 67/00* (2006.01)

(52) U.S. Cl. ..... 273/317.1; 273/317; 273/317.3; 273/317.5; 273/348; 273/399; 273/405

(58) Field of Classification Search ..... 273/317, 273/317.1, 317.3, 317.5, 348, 398–402, 405, 273/407; 206/216; 220/274, 575
See application file for complete search history.

(56) References Cited

U.S. PATENT DOCUMENTS

| | | | | |
|---|---|---|---|---|
| 5,082,140 | A | 1/1992 | Swenson | |
| 5,375,828 | A | 12/1994 | Shikami | |
| 5,465,961 | A | 11/1995 | Burtch | |
| 5,492,334 | A | 2/1996 | Carignan et al. | |
| 5,626,256 | A | 5/1997 | Onneweer | |
| 5,732,847 | A | 3/1998 | Caldi | |
| 5,851,012 | A | 12/1998 | Langieri, Jr. et al. | |
| 5,967,513 | A | 10/1999 | Wells | |
| 6,352,258 | B1 | 3/2002 | Fitzgerald et al. | |
| 6,443,859 | B1 * | 9/2002 | Markin | 473/451 |
| 6,663,108 | B2 * | 12/2003 | Makhoul | 273/317.3 |
| 6,772,745 | B2 * | 8/2004 | McEachen et al. | 124/6 |
| 7,611,146 | B2 * | 11/2009 | Arden | 273/317 |
| 2003/0034611 | A1 | 2/2003 | Lacy | |
| 2004/0239034 | A1 | 12/2004 | Tien | |
| 2007/0284824 | A1 * | 12/2007 | Arden | 273/317 |

FOREIGN PATENT DOCUMENTS

| | | |
|---|---|---|
| EP | 1520496 | 4/2005 |
| FR | 2715078 | 7/1995 |

* cited by examiner

*Primary Examiner*—Raleigh W. Chiu
(74) *Attorney, Agent, or Firm*—Bose McKinney & Evans LLP

(57) ABSTRACT

A multipurpose bowl assembly including a bowl, a target having a coupler configured to attach the target to the bowl and a launching device coupled to the bowl and configured to propel at least one item in a direction generally toward the target.

28 Claims, 15 Drawing Sheets

MULTIPURPOSE BOWL

RELATED APPLICATIONS

This application claims priority to U.S. Provisional Patent Application Ser. No. 60/887,480, filed Jan. 31, 2007, the disclosure of which is expressly incorporated herein in its entirety by this reference.

FIELD OF THE INVENTION

The present invention relates generally to a multipurpose bowl, and more particularly to a multipurpose food bowl that is adaptable for playing a variety of games.

BACKGROUND

In today's society, many people enjoy playing games or participating in various competitive activities while consuming food and/or beverage products. Most of these games, however, require the use or purchase of various extraneous objects, such as game pieces or game boards/consoles, before the game can be played. As such, it is desirable to have a multipurpose food bowl that overcomes one or more of the disadvantages noted above.

SUMMARY

The present invention provides a multipurpose bowl for playing a variety of games.

In one exemplary embodiment thereof, the present invention provides a multipurpose bowl assembly including a bowl, a target having a coupler configured to attach the target to the bowl and a launching device coupled to the bowl and configured to propel at least one item in a direction generally toward the target.

In another exemplary embodiment thereof, the present invention provides a novelty food launching kit. The novelty food launching kit comprises a multipurpose bowl, a plurality of interchangeable targets attachable to the bowl, and a launching device attachable to the bowl and configured to propel at least one item in a direction generally towards the target.

In yet another exemplary embodiment thereof, the present invention provides a multipurpose bowl assembly comprising a bowl, a target having a coupler configured to attach the target to the bowl, a launching device coupled to the bowl and configured to propel at least one item in a direction generally towards the target, and at least one modular insert configured to hold a variety of items adjacent the bowl.

Additional features of the present invention will become apparent to those skilled in the art upon consideration of the following detailed description and illustrative embodiments exemplifying the best mode of carrying out the invention as presently perceived.

BRIEF DESCRIPTION OF DRAWINGS

The above-mentioned aspects of the present invention and the manner of obtaining them will become more apparent and the invention itself will be better understood by reference to the following description of the embodiments of the invention taken in conjunction with the accompanying drawings, wherein.

Corresponding reference characters indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1A:
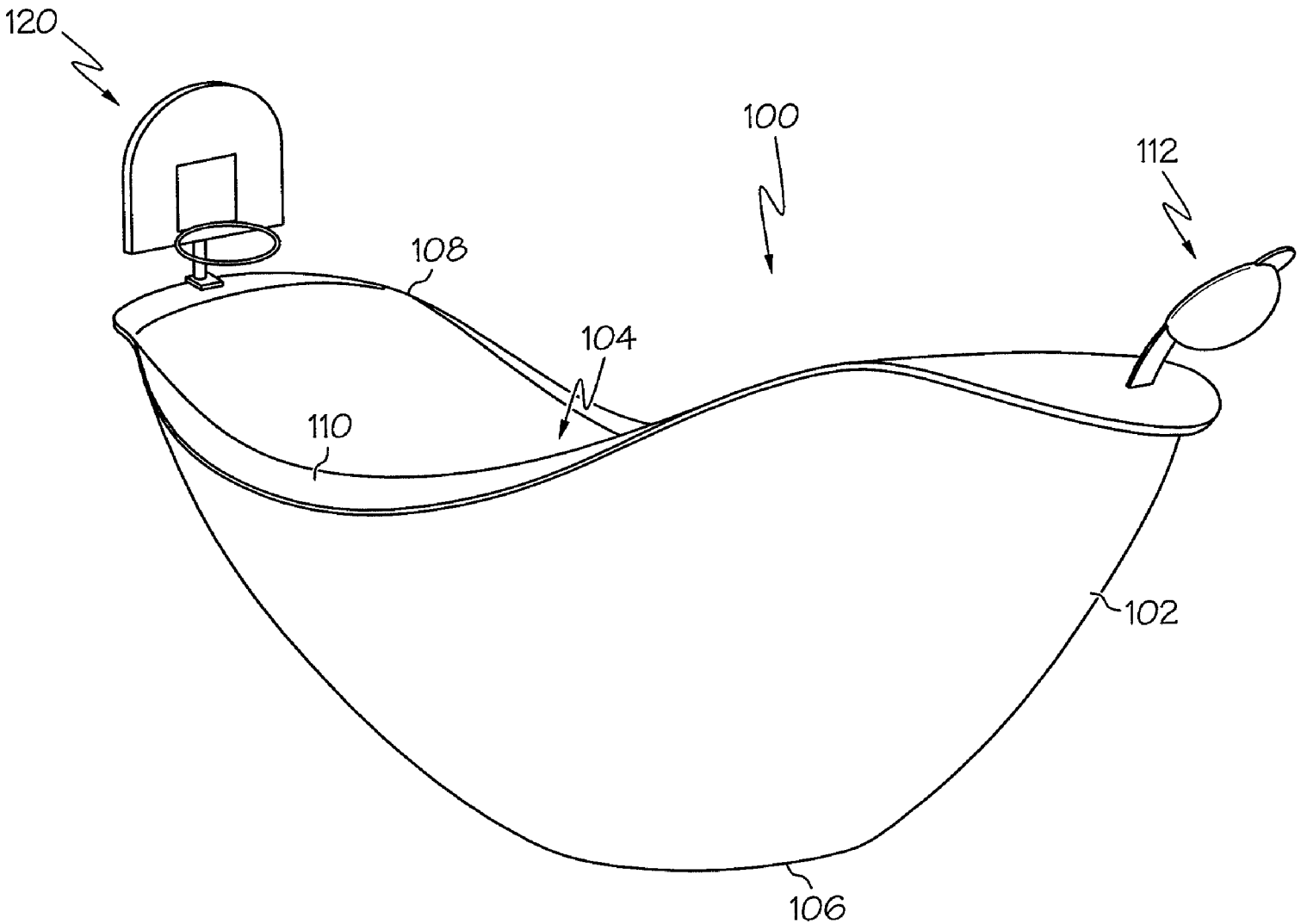
FIG. 1A is a perspective view of an exemplary multipurpose bowl in accordance with the present invention having a launching device and target coupled thereto.
Figure 1B:
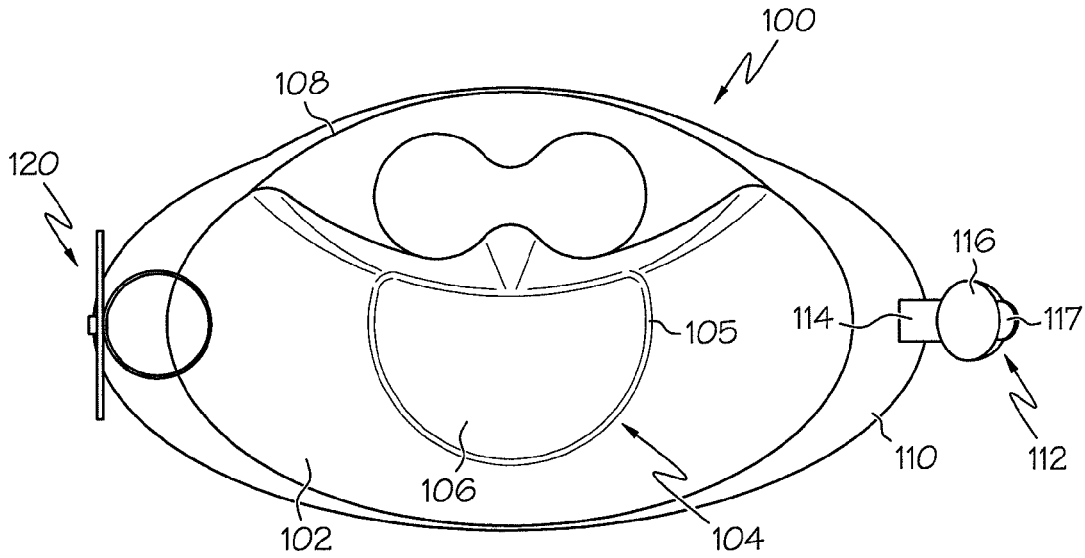
FIG. 1B is a top view of the exemplary multipurpose bowl of FIG. 1A.
Figure 1C:
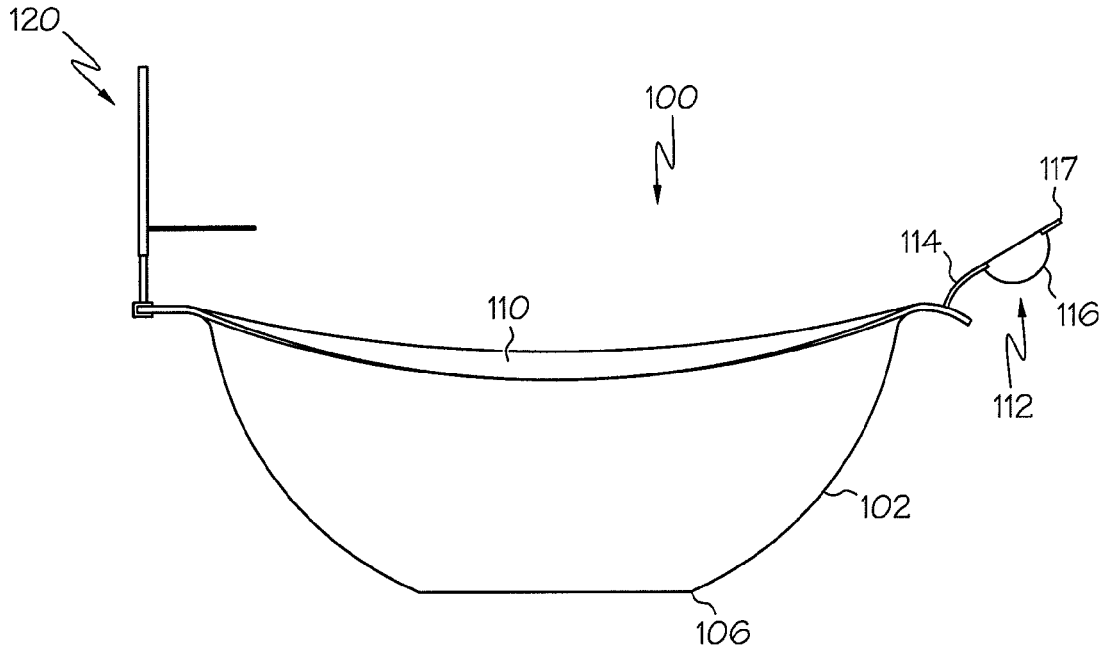
FIG. 1C is a side view of the exemplary multipurpose bowl of FIG. 1A.

Referring now to FIGS. 1A-1C, a multipurpose bowl 100 is shown. While the bowl 100 is shown in this aspect of the invention as being generally ellipsoidal in shape, it should be understood and appreciated herein that the bowl 100 can have any known geometrical shape (oval, round, ellipsoidal, etc.) without affecting the function or scope of the present invention. Moreover, the bowl 100 may be either circumferentially symmetrical or asymmetrical about a central, vertical axis (not shown) without straying from the scope of the present teachings. The only requirement the bowl 100 has with respect to its shape and configuration is that it be designed in such a manner that a generally concave internal hollow containment body is created for holding food or other such items.

In FIGS. 1A-1C, the bowl 100 has an upstanding peripheral wall 102 that defines the generally concave internal region 104 of the bowl and a generally flat base 106 that defines the bottom surface of the internal region 104. The peripheral wall 102 is integral with a peripheral edge 105 of the base 106 and arcs upwardly and outwardly therefrom to terminate in a substantially vertically upwardly directed rim 108. The rim 108 defines a geometric configuration (e.g., elliptical, round, oval, etc.) centered over the base 106 and is substantially enlarged relative thereto. Noting FIG. 1A in particular, in certain exemplary embodiments, the rim 108 of the bowl 100 may incline and/or decline slightly from one longitudinal end of the bowl 100 to the other longitudinal end along an arcuate path. Thus, the height of the peripheral wall 102 may vary from a maximum height at one or both ends of the bowl to a minimum height at some other point or points along the arcuate path of the rim 108.

The bowl 100, integral with the upper rim 108 thereof, also may include a peripheral outwardly extending flanged lip 110 that partially or completely surrounds the upper rim 108 of the bowl 100. The flanged lip 110 may have a constant width as it surrounds the upper rim 108 of the bowl 100 or it may be configured such that the width varies at certain regions along the periphery of the bowl. In certain aspects of the present invention, the flanged lip 110 may also serve as a handle for carrying the bowl 100. More particularly, a user can grasp the flanged lip 110 with their fingers to lift or carry the bowl as desired.

In addition to serving as handles, the flanged lip 110 may also function as a base or stage for mounting one or more objects along the upper periphery of the bowl 100. For instance, according to one aspect of the present invention, a launching device 112 can be coupled to the flanged lip 110 of the bowl 100 for launching or propelling various objects. To secure the launching device 112 to the flanged lip 110 of the bowl 100, any coupling/attachment means known within the art can be used. For instance, the launching device 112 can be coupled to the bowl 100 by molding, fusing, bolting, screwing, gluing, snapping, press fitting or the like. Additionally, while the launching device 112 may be permanently coupled to the flanged lip 110 of the bowl 100, the launching device may alternatively be configured to be releasably attachable to the bowl and/or the flanged lip of the bowl by way of a coupling device.

The bowl 100 and launching device 112 are both made from a resilient yet somewhat flexible material, such as an elastomeric material. Known elastomeric materials capable of being used to manufacture the bowl and launching device according to the present invention include, but are not limited to, thermoplastic vinyl materials, such as polyvinyl chlorides (PVC). Those skilled in the art will appreciate, however, that other resilient and flexible materials in addition to elastomeric materials may alternatively be used to manufacture the components of the present teachings while still staying within the scope of the present invention.

Figure 2A:
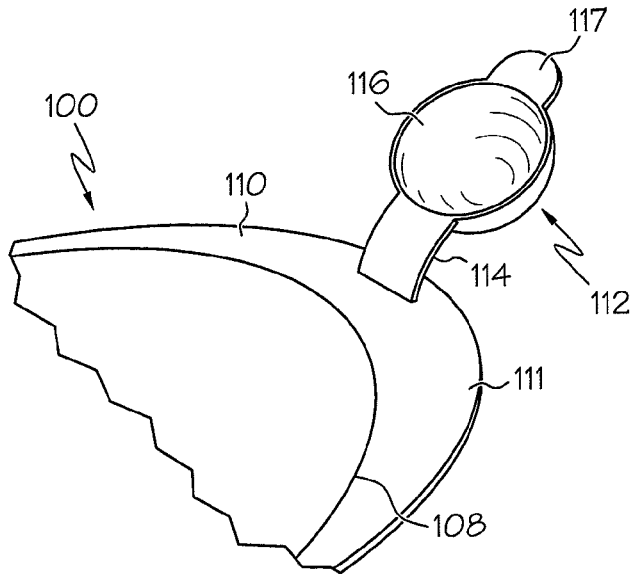
FIG. 2A is a fragmentary perspective view of a launching device attached to an exemplary multipurpose bowl in accordance with the present invention.
Figure 2B:
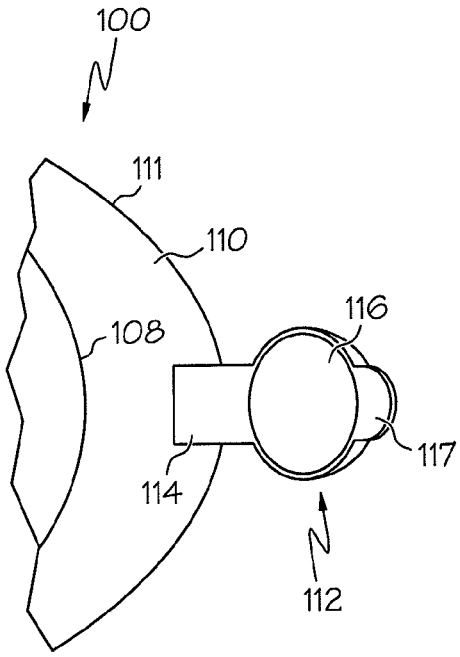
FIG. 2B is a fragmentary top view of the launching device of FIG. 2A.
Figure 2C:
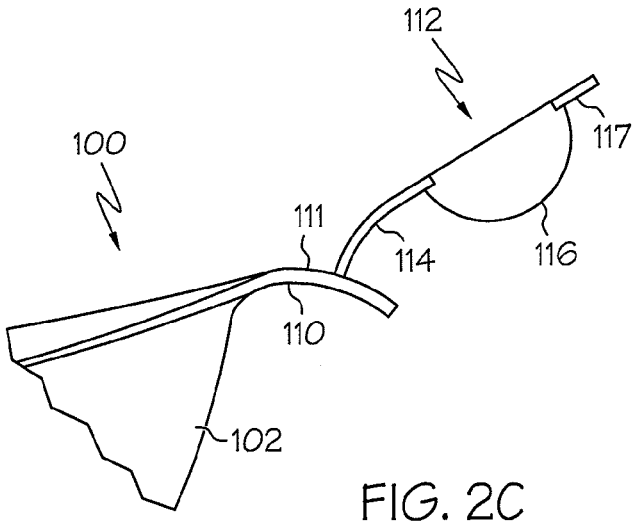
FIG. 2C is a fragmentary side view of the launching device of FIG. 2A.

As shown in FIGS. 2A-2C, the launching device 112 is provided at one end of the bowl and includes a resilient handle portion 114 and a scoop portion 116 for holding one or more items to be launched by the scoop. It should be understood and appreciated herein that depending on the angle to which it is desired to launch an item from the launching device 112, the launching device may be coupled to the flanged lip 110 at any angle with respect to the upper surface 111 of the flanged lip. For instance, in certain exemplary embodiments, the launching device 112 may be coupled to the flanged lip 110 at a 45-degree angle with respect to the upper surface 111. In other exemplary embodiments, however, it may be desirable to couple the launching device 112 to the flanged lip 110 at an angle that is either less or greater than 45 degrees. As such, the present teachings are not intended to be limiting herein.

Figure 3:
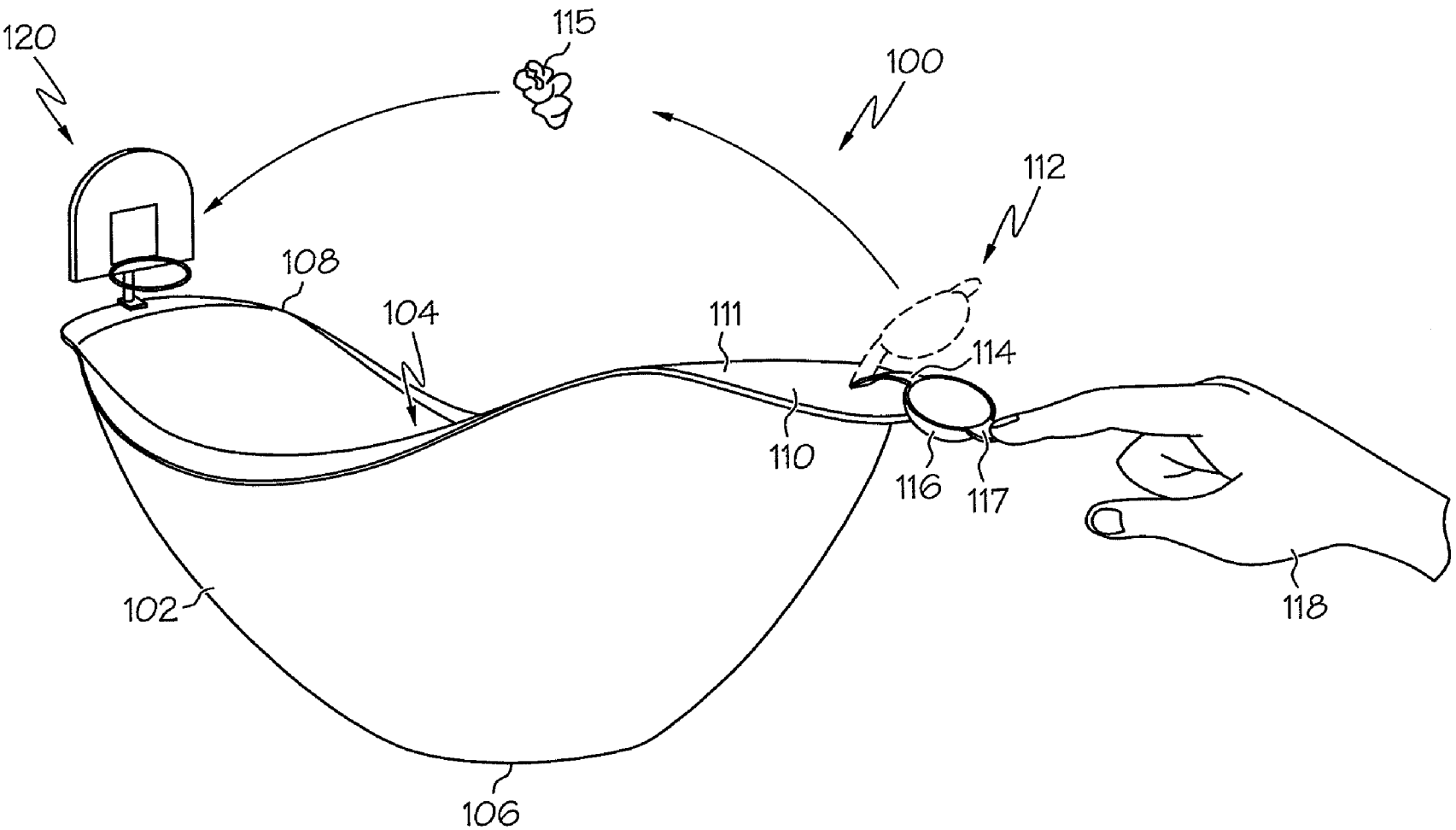
FIG. 3 is a perspective view of an exemplary multipurpose bowl in accordance with the present invention showing a user launching a food item towards a target attached to the bowl.

To launch an object or item from the launching device 112, a user 118 places the object to be launched in the scoop portion 116 of the launcher and presses a tab portion 117 downwardly towards the upper surface 111 of the flanged lip 110. Because the launching device, and particularly the handle portion 114 of the launching device, is made from a resilient material, the handle is configured to bend from a first position to a second position along a substantially vertical axis in a direction of the upper surface 111 of the flanged lip 110 without much difficulty. As shown in FIG. 3, when the user 118 releases the tab portion 117 of the launching device, the handle portion 114 causes the scoop 116 to return to its original relaxed state thereby propelling the object 115 into the air.

It should be understood and appreciated herein that a variety of objects may be propelled from the launching device 112 in accordance with the present invention. According to certain aspects of the invention, it may be desirable to launch food related items (e.g., the contents of the bowl) from the launching device. Some food related items that may be launched from the launching device 112 include, but not limited to, popcorn, candy, peanuts, pretzels, raisins, etc.

In addition to the launching device 112, in certain exemplary embodiments, it may also be desirable to couple a target to the bowl 100 for receiving the launched object 115. For instance, as shown in FIG. 3, a miniature basketball goal is attached to the flanged lip 110 portion of the bowl 100 to serve as a target 120 for receiving the object 115 (shown here as a piece of popcorn) that is being launched by the launching device 112. According to this embodiment, the target 120 is placed relatively directionally across from the launching device 112 so that when the object 115 is propelled into the air, it will be launched in the general direction of the target.

Figure 4B:
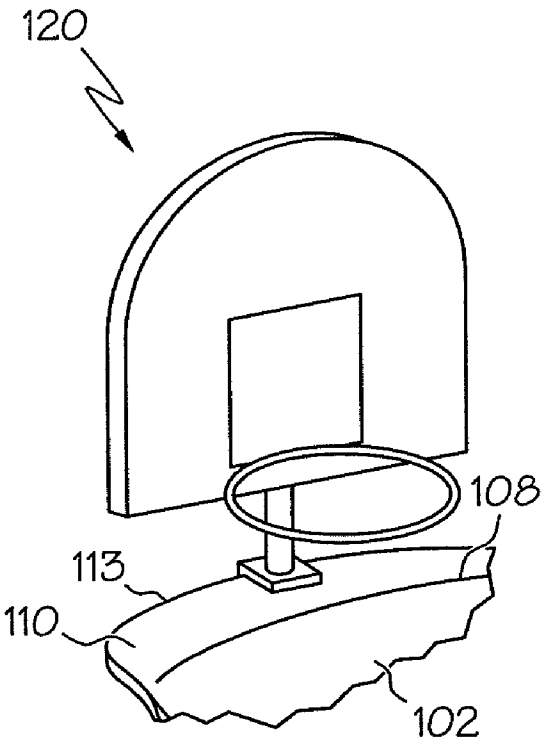
FIG. 4B is a fragmentary perspective view of the target from FIG. 4A shown attached to the rim of the bowl.
Figure 4A:
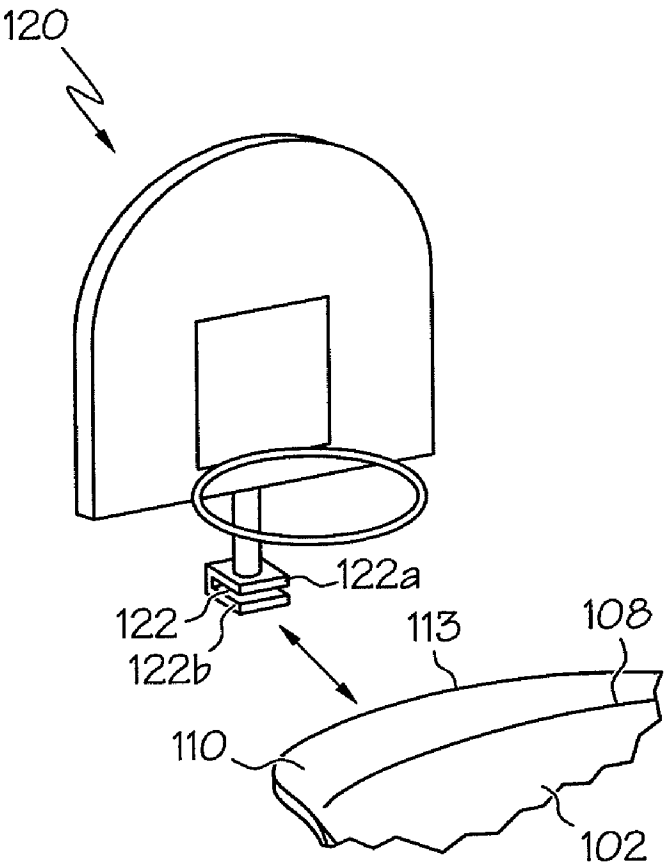
FIG. 4A is a fragmentary perspective view of an exemplary target shown unattached from the rim of a multipurpose bowl in accordance with the present invention.

Depending on what type of game the user desires to play (e.g., basketball, football, etc.), the target is adapted to be formed into many different shapes, such as basketball goals, football goals, etc. Additionally, while the target may be permanently coupled to the bowl 100, the target may alternatively be configured to be releasably attachable to the bowl and/or the flanged lip of the bowl by way of a coupling device. For instance, as best shown in FIGS. 4A-4B and 5A-5B, the targets (basketball goal and football goal, respectively) 120, 121 are removably attachable to the flanged lip 110 of the bowl 100 by two different attachment means. More particularly, FIGS. 4A-4B illustrate an attachment means in which the target 120 has a c-shaped cut-out or recess 122 at a bottom portion of the target that is adapted to be slid over the flanged lip 110. The shape of the recess 122 is designed in such a manner that it will tightly conform to an outer rim 113 of the flanged lip 110 as it is slid over such rim. To achieve this tight fit, the amount of space between the top 122*a* and bottom 122*b* portions of the recess define a width that is slightly less than the thickness of the outer rim 113 of the flanged lip. Despite having a width less than the thickness of the outer rim 113, the recess 122 is constructed of a resilient yet flexible material as described above. This material will allow the top portion 122*a* and the bottom portion 122*b* of the recess to slightly separate from one another as the recess is slid over the outer rim of the bowl thereby achieving a snug-like attachment of the target to the bowl.

Figure 5B:
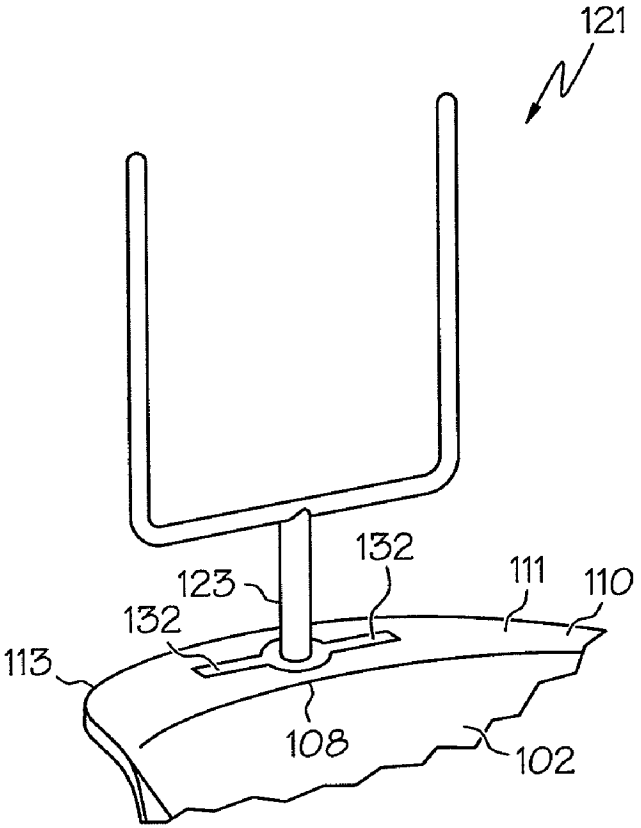
FIG. 5B is a fragmentary perspective view of the target from FIG. 5A shown attached to the rim of the bowl.
Figure 5A:
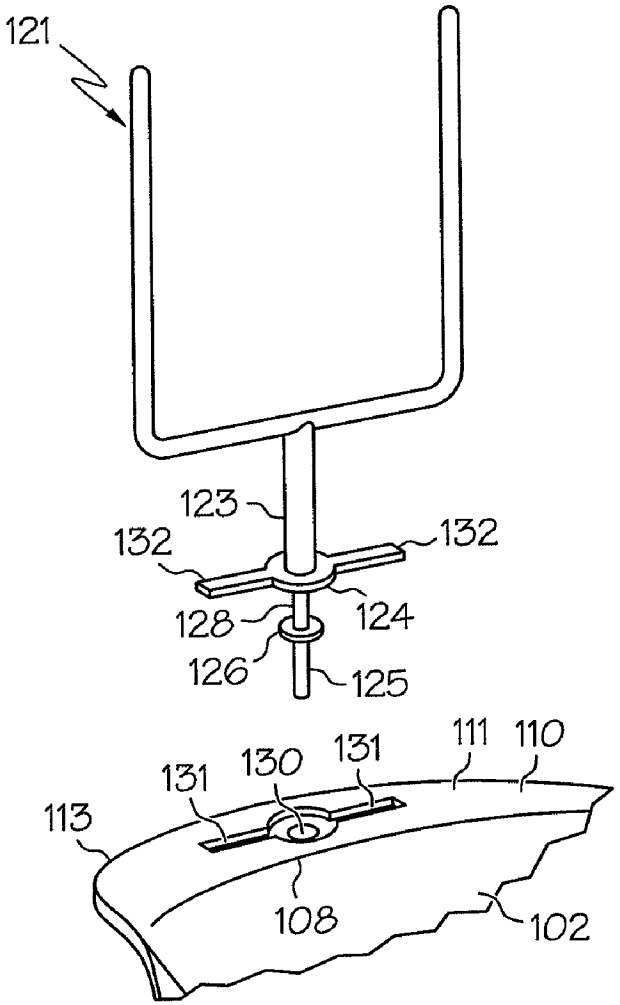
FIG. 5A is another fragmentary perspective view of an exemplary target shown unattached from the rim of a multipurpose bowl in accordance with the present invention.

An alternative means for attaching a target in accordance with the present invention is shown with reference to FIGS. 5A-5B. According to this exemplary embodiment, the target 121 has a vertical pole 123 with an upper-flanged structure 124 and lower-flanged structure 126 that together define an internal recess 128. To attach the target 121 to the flanged lip 110 of the bowl 100, the bottom portion 125 of the vertical pole 123 is fitted over a hole 130 located on the upper surface 111 of the flanged lip 110. After placing the bottom portion 125 over the hole 130, the vertical pole is advanced downwardly until the lower-flanged structure 126 encounters the outer circumference of the hole 130 on the upper surface of the flanged lip. To advance the lower flanged structure 126 through the hole 130, the circumference of the lower-flanged structure is configured such that it is slightly less than the circumference of the hole. After the lower-flanged structure 126 is advanced through the hole 130, eventually the upper-flanged structure 124 will also encounter the hole 130. Unlike the lower-flanged structure 126, the upper-flanged structure 124 of the target 121 is shaped such that its circumference is larger than that of the hole 130. As such, the upper-flanged structure 124 is prevented from advancing through the hole, whereby the target 121 is essentially snapped into place by sandwiching the hole with the upper and lower flanged structures.

After the target 121 has been attached to the flanged lip 110 of the bowl 100, it may also be desirable to discourage the target 121 from wobbling from side-to-side as it rests upon the upper surface 111 of the flanged lip 110. To discourage this side-to-side movement, the upper-flanged structure 124 may also comprise horizontal wings 132 that extend outwardly from the upper-flanged structure 124. According to this embodiment, the hole 130 on the upper surface 111 of the flanged lip 110 also includes a pair of divots 131 that serve as a complementary set of horizontal wings that are designed to correspond to the horizontal wings 132 of the upper-flanged structure 124. As such, when the target 121 is inserted into the hole 130 as explained above, the horizontal wings 132 of the upper-flanged structure 124 are aligned with the pair of divots 131 of the hole 130. When the upper-flanged structure 124 is completely lowered into the hole 130, the horizontal wings 132 snuggly fit into the recess formed by the pair of divots 131. As these horizontal wings 132 extend horizontally outward from the upper-flanged structure, the target 121 is prevented from being wobbled from side-to-side. In other words, when the target 121 is moved from side-to-side, the horizontal wings 132 of the upper-flanged structure 124 will encounter the bottom surface of the pair of divots 131 and thereby be prohibited from exhibiting further horizontal movement. It should be understood that these horizontal wings are not required according to the present invention, yet may be utilized for further stability of the target if desired. Moreover, it should also be appreciated that other means for attaching a target to a bowl (or attaching a target to the flanged lip of the bowl) are possible, whereby the present teachings are not intended to be limiting herein.

Figure 6A:
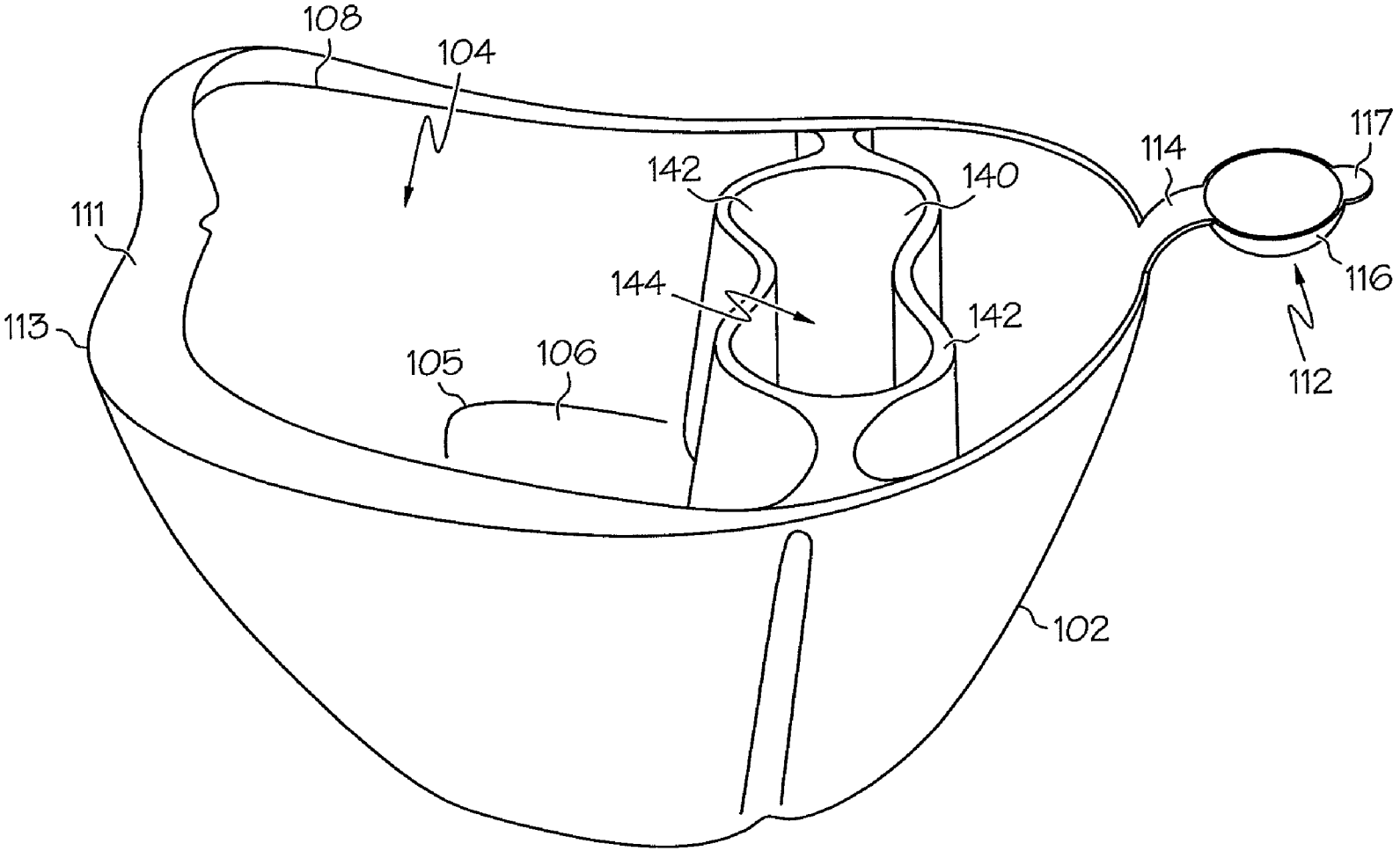
FIG. 6A is a perspective view of an exemplary multipurpose bowl in accordance with the present invention having an insert associated therewith.

In addition to having a launching device and/or a target, the exemplary bowls of the present invention may also comprise one or more modular inserts or compartments designed to hold a variety of items, such as food/beverage items, napkins, crayons, etc. These inserts may be permanently attached to the bowl or removably attachable thereto. One such exemplary insert is shown with reference to FIG. 6A. According to this exemplary embodiment, insert 140 is configured to function as a dual beverage holder or carrier. It should be understood and appreciated herein that such beverage holders may vary in size and shape to accommodate different sizes of beverages as desired. Here, insert 140 has a frusto-conical figure-eight arrangement having a curved/tapered sidewall 142, a flat or slightly concave bottom (not shown) and an open top 144 for inserting a beverage.

Figure 6B:
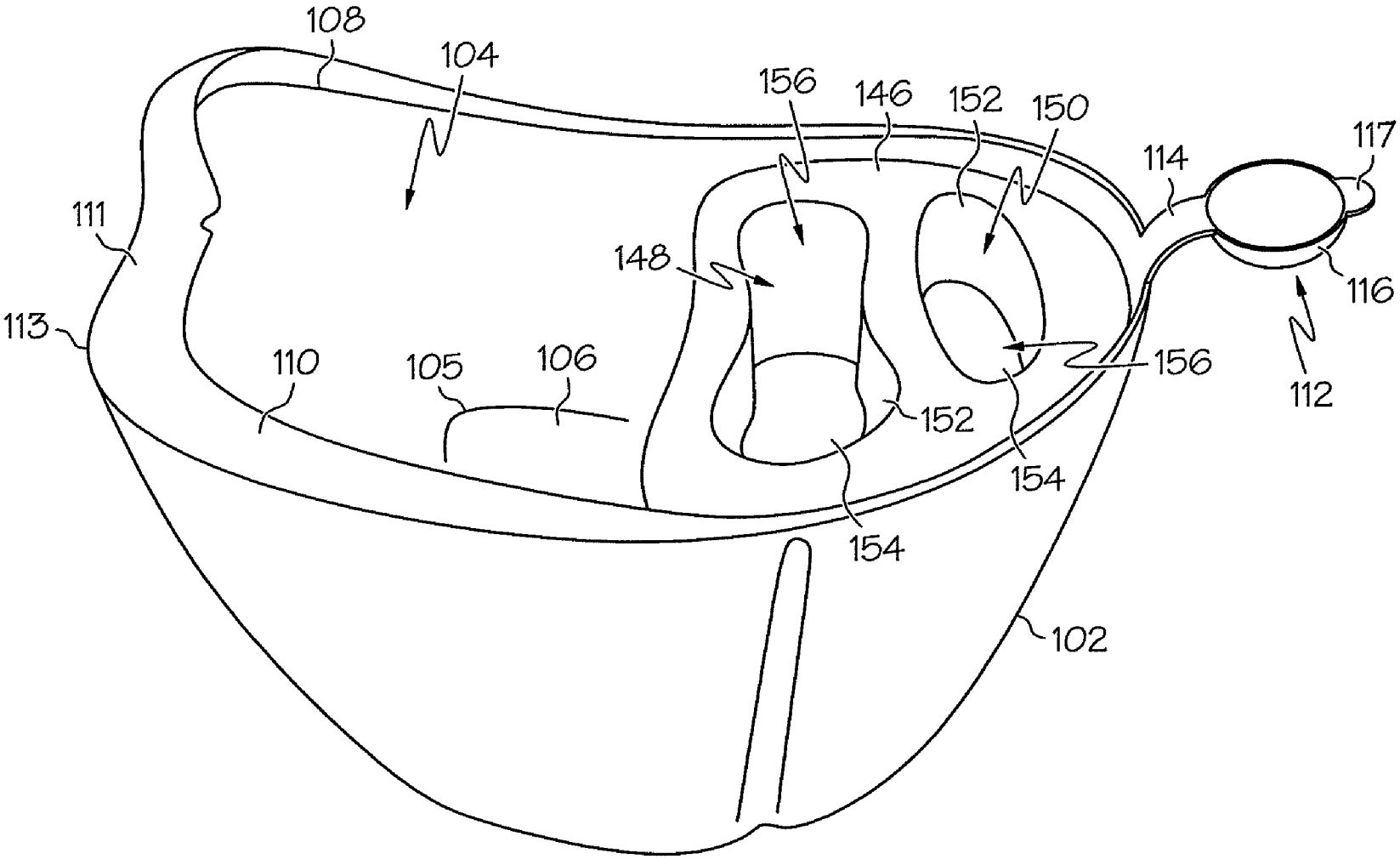
FIG. 6B is a perspective view of the exemplary multipurpose bowl from FIG. 6A having another insert associated therewith.

Another exemplary modular insert is shown in FIG. 6B. According to this embodiment, the insert 146 has two recessed portions 148, 150 that are configured to hold a variety of items. These recessed portions 148, 150 each have a curved/tapered sidewall 152 and a flat or slightly concave bottom 154 and an open top 156 for inserting the objects to be held. The modular inserts can be formed of a molded pulp or a form plastic material (such as described above) that is inexpensive, disposable, heat and cold resistant, and yet capable of providing adequate resilience, strength or rigidity for simultaneously supporting a plurality of objects as described above.

To attach the modular inserts to the bowl, any attachment means known within the art may be used. Such exemplary attachment means include, but are not limited to, sliding, bolting, screwing, gluing, snapping or press fitting the insert to the bowl. In one aspect of the invention, the insert may include a recessed slot section that is configured to align with a complementary ridge located on the inner surface of the bowl (not shown). According to this embodiment, the user aligns the recessed slot of the insert with the internal ridge of the bowl and presses down on the insert, thereby advancing the ridge into the slot to achieve a locking fit. In yet other exemplary embodiments, the insert may include the ridge section and the bowl will have the recessed slot. It is envisioned that many other attachment means for inserting modular inserts in accordance with the present invention may also be used by those skilled within the art. As such, the present teachings are not intended to be limiting herein.

Figure 7A:
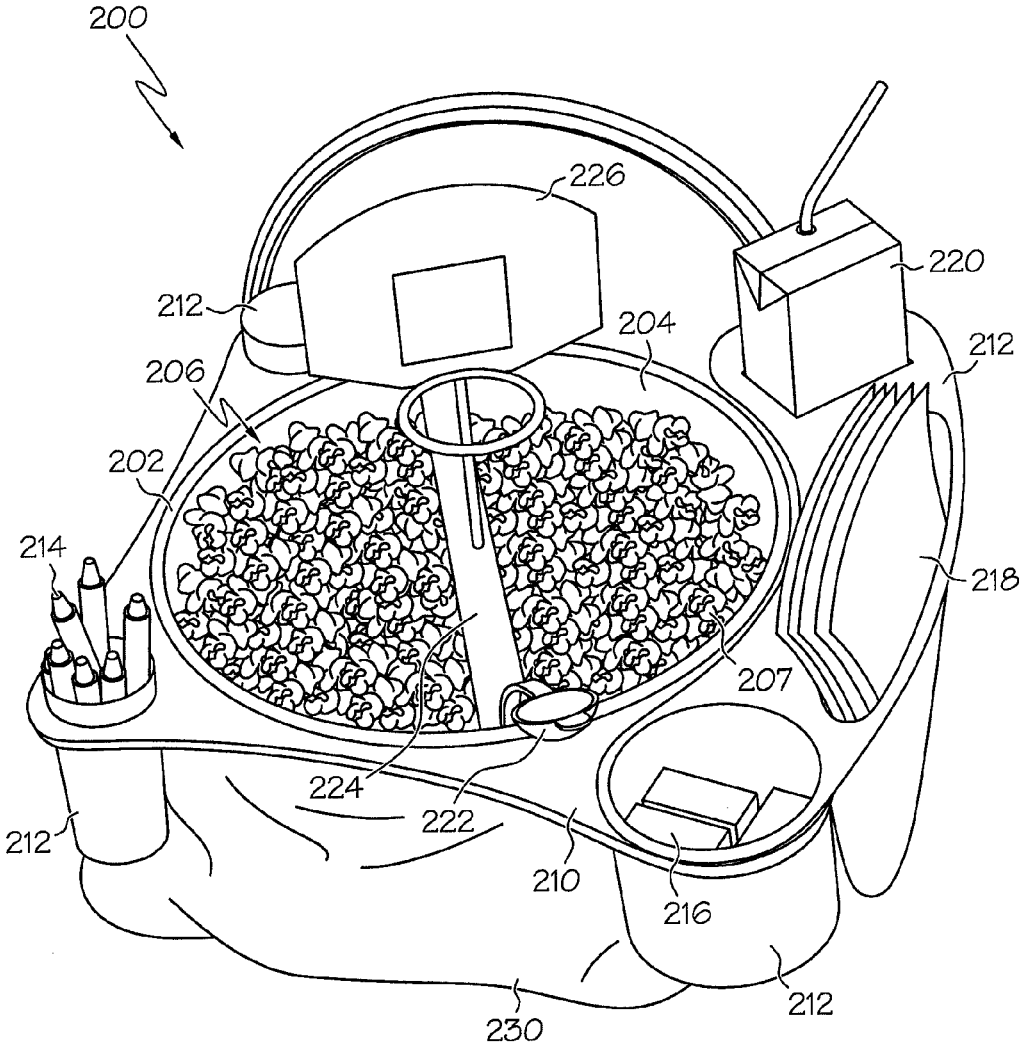
FIG. 7A is a perspective view of an exemplary multipurpose bowl in accordance with the present invention having a launching device, a target, a plurality of modular inserts and an outer casing.
Figure 7B:
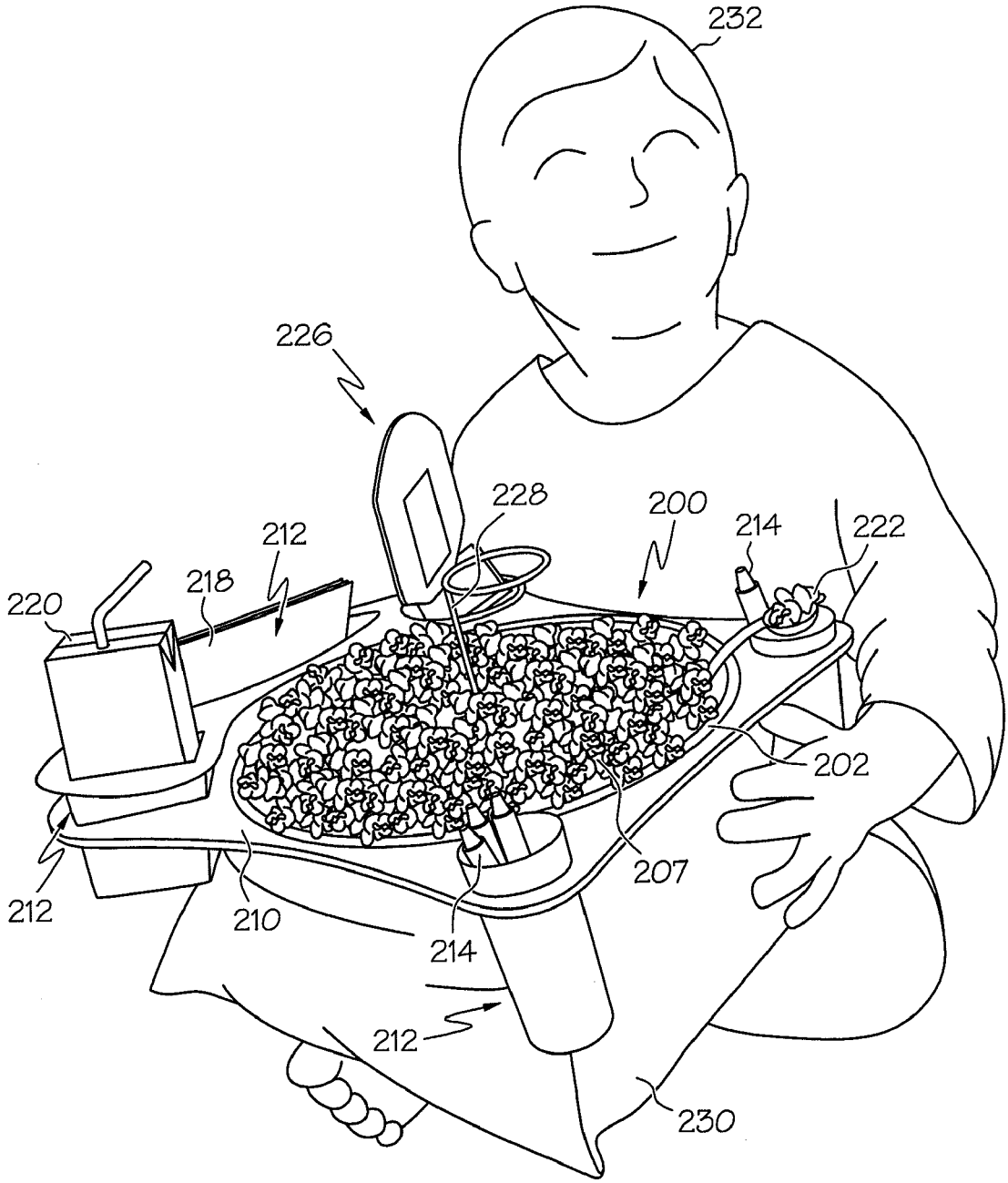
FIG. 7B is a perspective view of another multipurpose bowl being held by a user and having a launching device, a target, a plurality of modular inserts, and an outer casing.

Turning now to FIGS. 7A and 7B, another exemplary bowl in accordance with the present invention is illustrated. According to this embodiment, bowl 200 is shown having a substantially round upper rim 202 that together with upstanding peripheral wall 204 define a concave internal hollow containment body 206 for holding an item, such as popcorn 207. The bowl 200, integral with the upper rim 202 thereof, also includes a peripheral outwardly extending flanged lip 210 that surrounds the upper rim 202 of the bowl 200. While the flanged lip 210 may have a constant width as it surrounds the upper rim 202 of the bowl 200, in this exemplary embodiment the width of the flanged lip 210 varies at certain locations along the periphery of the bowl. The varying width of the flanged lip 210 is configured in such a manner that a variety of modular inserts 212 may be placed at desirable locations along the outer periphery of the bowl. In this illustration, the modular inserts 212 are designed to hold items such as crayons 214, raisins 216, napkins 218 and a drink box 220. However, it should be understood and appreciated herein that various other alternative items may also be placed within the modular inserts as desired.

The upper rim 202 of the bowl 200 also includes a launching device 222 that is adapted to launch or propel an item into the air as described in detail above. In certain exemplary embodiments, the bowl may also include a divider 224 that extends vertically upward from the base (not shown) of the internal hollow containment body 206 (see FIG. 7A). While only popcorn 207 is shown within the bowl 200 of this embodiment, it is envisioned that one may decide to use the divider 224 as a means for separating two different food and/or non-food items in other applications. Also, according to this embodiment, a target 226 to which the launching device 222 is adapted to launch an object towards is shown directly coupled to the divider 224. As such, it should be understood that the target does not need to be attached directly to the flanged lip 210 or to the bowl itself (as explained above) to stay within the scope of the present teachings. In fact, it is also possible for the target to be placed directly into the contents of the bowl so that it is held up vertically by the weight of the bowl's contents itself. Such an arrangement is illustrated, for instance, with reference to FIG. 7B. Here, the vertical pole 228 of the target 226 is placed down into the popcorn 207 so that it is held upright by the weight of the surrounding popcorn.

Another feature of the present invention as shown in FIGS. 7A and 7B is the incorporation of a soft outer casing 230 to the bottom of the bowl 200. When the soft outer casing is attached to the bowl, a user 232 can hold the bowl easily and comfortably in their lap. The soft outer casing 230 can be attached to the bowl by any known attachment means known within the art such as, but not limited to, snapping, bolting, screwing, sewing, threading, gluing, molding, or by a Velcro® means. In certain aspects of the present invention, the soft outer casing 230 is attached to the flanged lip 210 of the bowl, while in other aspects of the present invention the soft outer casing is attached to the upper rim 202 of the bowl 200.

The soft outer casing 230 may be permanently attached to the bowl 200 or removable from the bowl to be washed or replaced as needed. To achieve the soft characteristics desired of the outer casing, the casing 230 can be formed of a typical upholstery material or fabric and filled with small chunks of a soft and resilient material, such as styrofoam, PVC pellets or other like materials. Useful fabrics for the casing include, but are not limited to, leather, vinyl, cloth, velvet, imitation suede, canvas, etc. One exemplary example of such a material that can be used for the outer casing of the present invention is a beanbag material. Beanbag materials are known within the art and do not require further discussion herein.

Figure 8A:
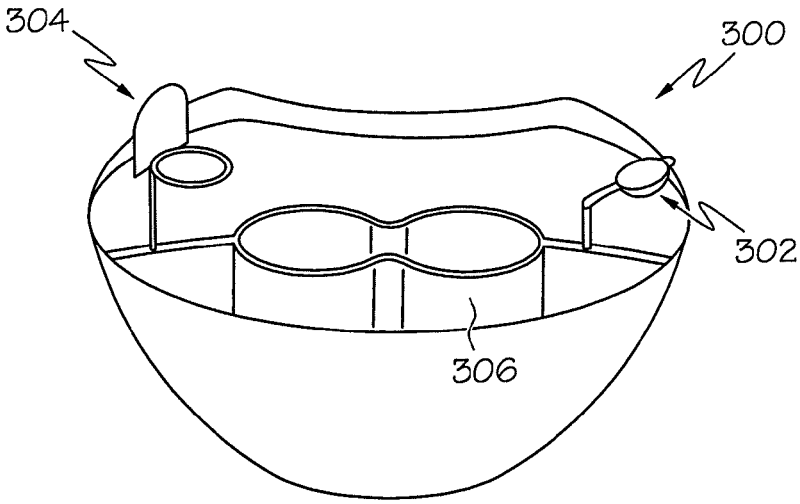
FIG. 8A is a perspective view of an exemplary multipurpose bowl having an insert with a launching device and target coupled thereto in accordance with the present invention.
Figure 8B:
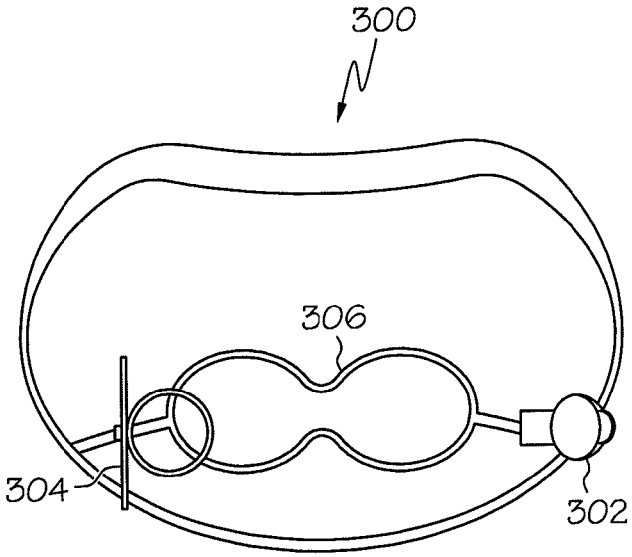
FIG. 8B is a top view of the exemplary multipurpose bowl of FIG. 8A.
Figure 8C:
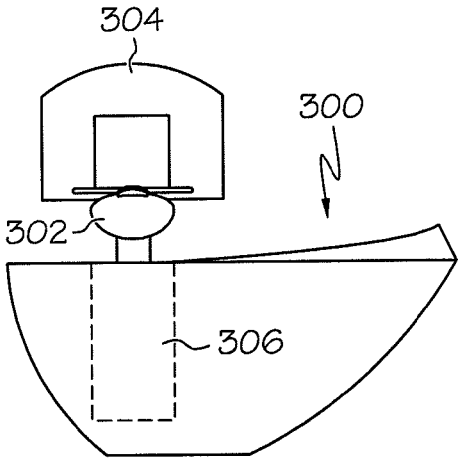
FIG. 8C is a side view of the exemplary multipurpose bowl of FIG. 8A.

As explained in detail above, the launching devices and targets of the present invention may be attached directly to the bowl or its flanged lip and/or attached to a divider placed into the internal hollow containment body of the bowl. In yet other aspects of the present invention, the launching device and/or target may alternatively be attached to one or more modular inserts of the bowl. For instance, as shown in FIGS. 8A-8C, launching device 302 and target 304 are coupled to a modular insert 306 of the bowl 300.

Figure 9A:
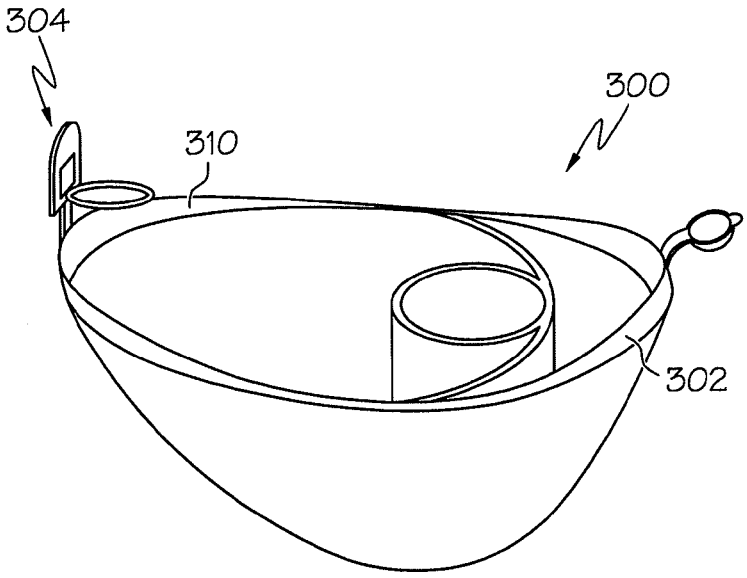
FIG. 9A is a perspective view of an exemplary multipurpose bowl having a curved shelf integral with the rim of the bowl for preventing contents from spilling out of the bowl in accordance with the present invention.
Figure 9B:
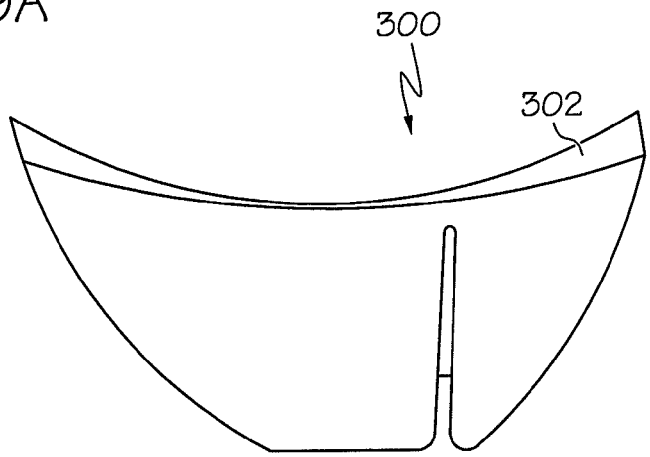
FIG. 9*b* is a side view of the exemplary multipurpose bowl of FIG. 9A.
Figure 9C:
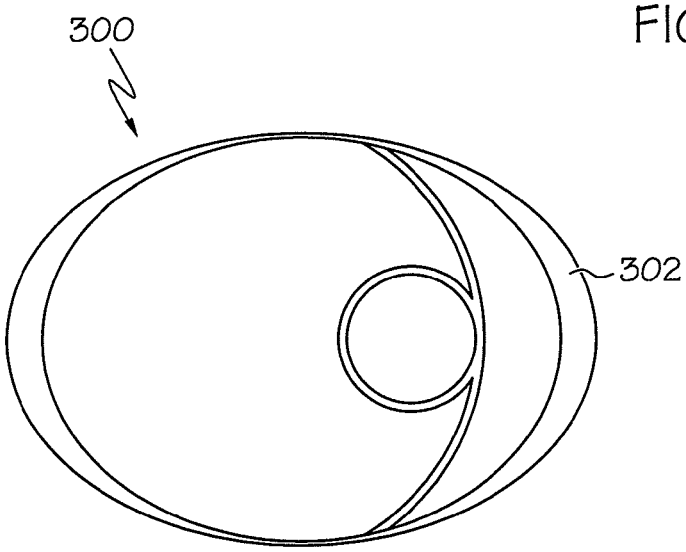
FIG. 9*c* is a top view of the exemplary multipurpose bowl of FIG. 9A.

In addition to a flanged lip that is integral with the upper rim of the bowl, in other aspects of the invention, a curved ridge or shelf may also be used to discourage spillage of the contents held within the bowl. For instance, as shown within FIGS. 9*a*-9*c*, the bowl 300 includes an inwardly directed shelf 302 that is integral with the upper rim 310 of the bowl. The shelf 302 is designed in such a manner that it is curved or positioned slightly inward to create a lip at the upper surface of the bowl. In the event the bowl 300 is tilted or rotated from the horizontal, the contents contained therein will encounter the inwardly positioned shelf 302 and thereby be prevented or discouraged from spilling out of the bowl.

Figure 10A:
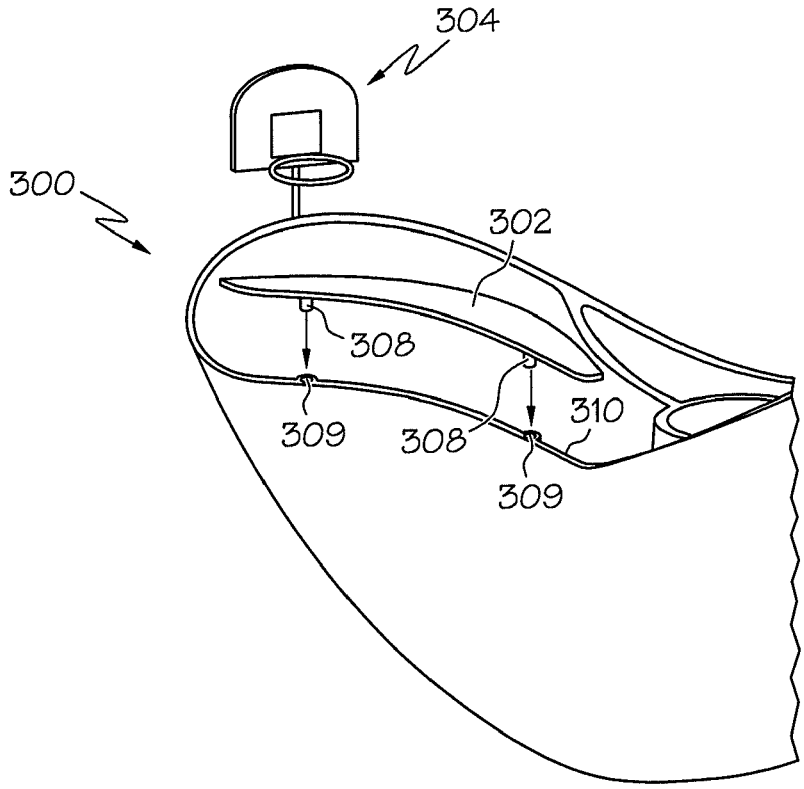
FIG. 10A is a fragmentary perspective view of an exemplary multipurpose bowl in accordance with the present invention showing a flanged lip structure being unattached from the rim of the bowl.
Figure 10B:
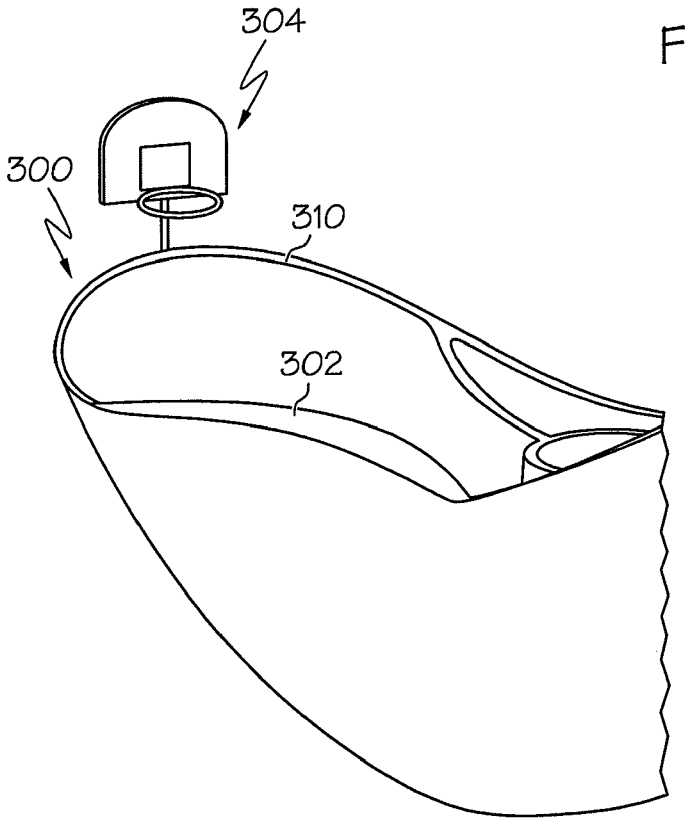
FIG. 10B is a fragmentary perspective view of the exemplary multipurpose bowl of FIG. 10A showing the flanged lip structure attached to the rim of the bowl.

The shelf 302 may be permanently attached to the bowl 300 or configured to be removable in nature. For instance, as shown in FIGS. 10A-10B, shelf 302 contains pegs 308 on its bottom surface, which can be aligned with a series of complementary holes 309 contained on the upper rim 310 of the bowl 300 to attach the shelf. To attach the shelf 302 to the upper rim 310 of the bowl 300, the user inserts the pegs 308 within the holes 309 and presses down to achieve a snap fit. While this aspect of the invention shows a snap-fit arrangement of the shelf to the bowl, it is envisioned that many other attachment means known within the art can be used to achieve a similar effect. As such, the present teachings are not intended to be limiting herein. It should also be understood and appreciated that the size and shape of the shelf 302 may be modified as desired to achieve various levels of protection for preventing the contents of the bowl from spilling out when the bowl is tilted past the horizontal.

Figure 11A:
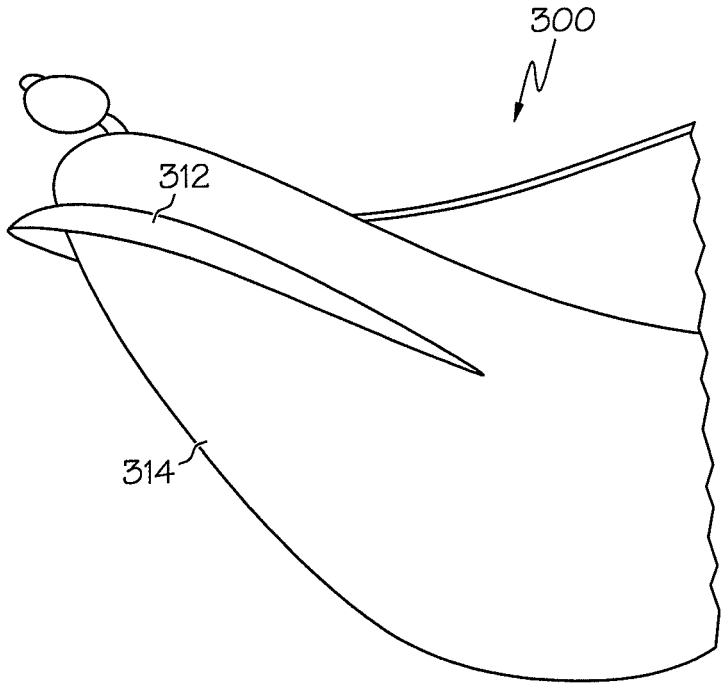
FIG. 11A is a fragmentary perspective view of an exemplary multipurpose bowl in accordance with the present invention showing a flanged handle section attached to the end of the bowl.
Figure 11B:
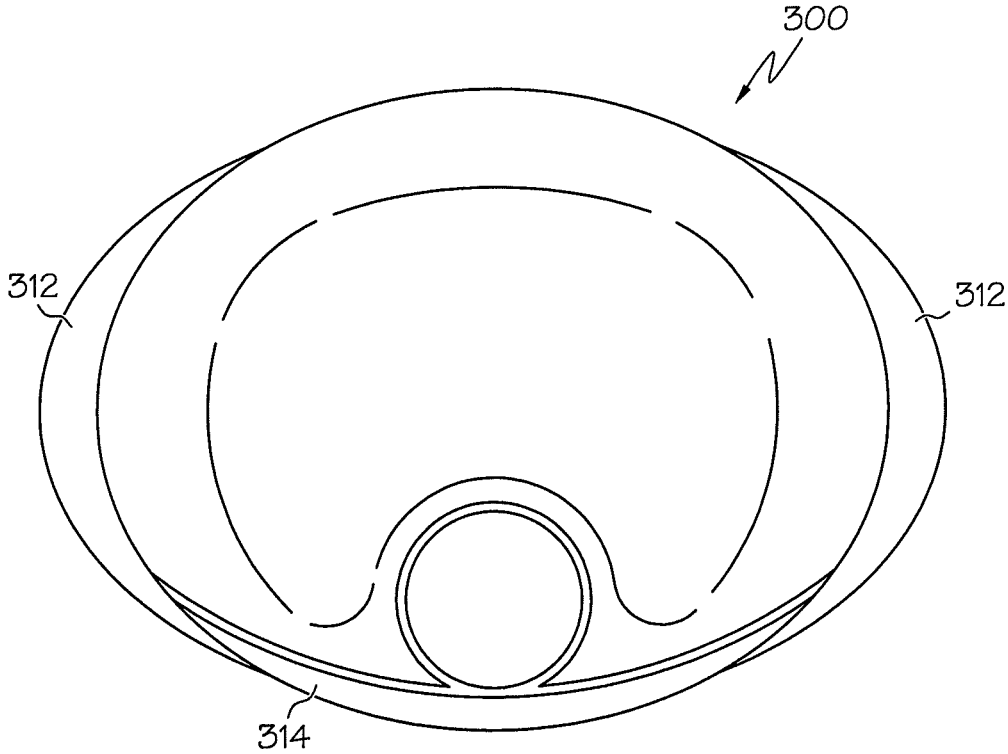
FIG. 11B is a top view of the exemplary multipurpose bowl of FIG. 11A.

In addition to attachable shelves, the exemplary bowls of the present invention may also comprise one or more attachable handles to the outside surface of the bowl. For instance, as shown in FIGS. 11A and 11B, curved handle 312 is coupled to the outside surface 314 of the bowl 300. Once attached to the bowl 300, a user can grasp underneath the curved handle 312 with their fingers to lift or carry the bowl as desired. Such exemplary handles can be attached to the bowl 300 by any attachment means known within the art, such as, but not limited to, molding, fusing, bolting, screwing, gluing, snapping, press fitting or the like.

Figure 12:
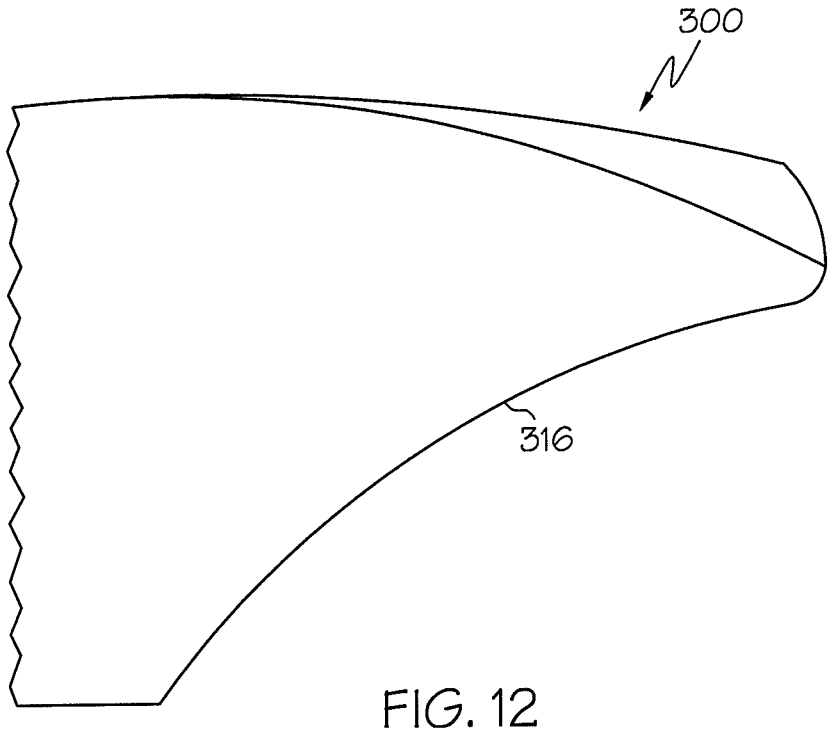
FIG. 12 is a fragmentary side view of an exemplary multipurpose bowl in accordance with the present invention and having a contoured end wall.

Another feature of the present invention as shown in FIG. 12 is the incorporation of a curved or contoured shape to one or more of the end walls 316 of the bowl. By designing the bowl to include such an exaggerated contoured shape, a user can hold the bowl 300 in their lap easily and comfortably during use.

Figure 13:
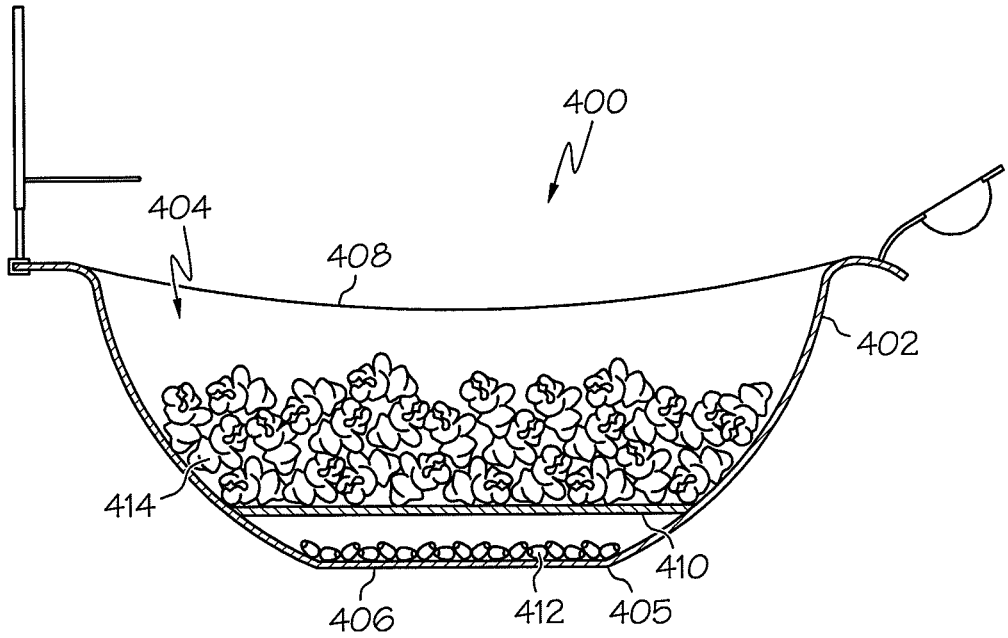
FIG. 13 is a side view of an exemplary multipurpose bowl in accordance with the present invention containing popcorn and having a separator device for separating the popped popcorn from the unpopped popcorn kernels.

Still other features of the present invention include the incorporation of a bottom section to the bowl that is designed to separate popped popcorn from unpopped popcorn kernels. For instance, FIG. 13 shows a bowl 400 having an upstanding peripheral wall 402 that defines a generally concave internal region 404 of the bowl and a generally flat base 406 that defines the bottom surface of the internal region 404. Peripheral wall 402 is integral with a peripheral edge 405 of the base 406 and arcs upwardly and outwardly therefrom to terminate in a substantially vertically upwardly directed rim 408. In addition to the flat base 406 that defines the bottom of the bowl, the bowl 400 also includes a horizontal separator section 410 that is substantially parallel to the base 406 of the bowl. The separator section 410 includes a series of openings (not shown) each of which have a diameter or width that is larger than the diameter or width of a typical popcorn kernel, yet smaller than the typical diameter or width of a piece of popped popcorn. An exemplary width or diameter of such opening according to one aspect of the present invention is about 3 mm to about 10 mm, specifically from about 4.5 mm to about 8 mm, and even more specifically from about 5 mm to about 7 mm. The shape of the openings can be any known configuration that will allow the unpopped popcorn kernels (shown as reference numeral 412 in FIG. 13) to fall through the openings, yet will prevent the popped popcorn (reference numeral 414) from similarly falling through.

While an exemplary embodiment incorporating the principles of the present invention has been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A multipurpose bowl assembly, comprising:

a bowl;

a target having a coupler, the coupler being configured to attach the target to the bowl; and a launching device coupled to the bowl and configured to propel at least one item in a direction generally towards the target.

2. The multipurpose bowl assembly of claim 1, wherein the launching device includes a scoop portion, the scoop portion being configured to hold the at least one item to be propelled.

3. The multipurpose bowl assembly of claim 2, wherein the scoop portion is coupled to the bowl by way of a handle portion, the handle portion being manufactured from a resilient material that is bendable along a substantially vertical axis from a first position to a second position.

4. The multipurpose bowl assembly of claim 1, wherein the target further comprises a pair of wings adapted to prevent the target from moving from side-to-side.

5. The multipurpose bowl assembly of claim 1, further comprising an outwardly extending flanged lip that at least partially surrounds an upper rim of the bowl.

6. The multipurpose bowl assembly of claim 5, wherein the target is coupled to bowl by way of the flanged lip.

7. The multipurpose bowl assembly of claim 5, further comprising a shelf integral with the upper rim of the bowl, the shelf being adapted to prevent spillage of any contents being held within the bowl.

8. The multipurpose bowl assembly of claim 1, wherein the target is coupled to the bowl by an attachment means selected from at least one of molding, fusing, bolting, screwing, gluing, snapping and press fitting.

9. The multipurpose bowl assembly of claim 1, further comprising at least one modular insert adapted to hold a variety of items.

10. The multipurpose bowl assembly of claim 9, wherein the target is coupled to the bowl by way of the at least one modular insert.

11. The multipurpose bowl assembly of claim 1, further comprising an outer casing adapted to allow a user to hold the bowl in a comfortable manner.

12. The multipurpose bowl assembly of claim 1, further comprising at least one handle for carrying the bowl.

13. The multipurpose bowl assembly of claim 1, further comprising a separator device, the separator device being configured to separate a variety of items held within the bowl.

14. The multipurpose bowl assembly of claim 13, wherein the separator device is configured to separate pieces of popped popcorn from unpopped popcorn kernels.

15. A novelty food launching kit, comprising:

a multipurpose bowl;

a plurality of interchangeable targets attachable to the bowl; and a launching device attachable to the bowl and configured to propel at least one item in a direction generally towards the target.

16. The novelty food launching kit of claim 15, wherein the launching device includes a scoop portion, the scoop portion being configured to hold the at least one item to be propelled.

17. The novelty food launching kit of claim 16, wherein the scoop portion is coupled to the bowl by way of a handle portion, the handle portion being manufactured from a resilient material that is bendable along a substantially vertical axis from a first position to a second position.

18. The novelty food launching kit of claim 15, wherein the bowl further comprises at least one modular insert adapted to hold a variety of items.

19. The novelty food launching kit of claim 18, wherein the target is coupled to the bowl by way of the at least one modular insert.

20. The novelty food launching kit of claim 15, wherein the bowl further comprises a separator device, the separator device being configured to separate a variety of items held within the bowl.

21. The novelty food launching kit of claim 20, wherein the separator device is configured to separate pieces of popped popcorn from unpopped popcorn kernels.

22. The novelty food launching kit of claim 15, wherein the target resembles at least one of a basketball goal and a football goal.

23. A multipurpose bowl assembly, comprising:

a bowl;

a target having a coupler, the coupler being configured to attach the target to the bowl;

a launching device coupled to the bowl and configured to propel at least one item in a direction generally towards the target; and at least one modular insert, the modular insert configured to hold a variety of items adjacent the bowl.

24. The multipurpose bowl assembly of claim 23, wherein the launching device includes a scoop portion that is configured to hold the at least one item to be propelled.

25. The multipurpose bowl assembly of claim 24, wherein the scoop portion is coupled to the bowl by way of a handle portion, the handle portion being manufactured from a resilient material that is bendable along a substantially vertical axis from a first position to a second position.

26. The multipurpose bowl assembly of claim 23, further comprising an outer casing adapted to allow a user to hold the bowl in a comfortable manner.

27. The multipurpose bowl assembly of claim 23, further comprising at least one handle for carrying the bowl.

28. The multipurpose bowl assembly of claim 23, further comprising a separator device, the separator device being configured to separate a variety of items held within the bowl.

* * * * *